US010625144B1

(12) United States Patent
Hamilton

(10) Patent No.: US 10,625,144 B1
(45) Date of Patent: Apr. 21, 2020

(54) HAND-HELD POWERED POOL CUE TIP SHAPER

(71) Applicant: John G. Hamilton, Anchorage, AK (US)

(72) Inventor: John G. Hamilton, Anchorage, AK (US)

( * ) Notice: Subject to any disclaimer, the term of this patent is extended or adjusted under 35 U.S.C. 154(b) by 0 days.

(21) Appl. No.: 15/712,502

(22) Filed: Sep. 22, 2017

(51) Int. Cl.
*A63D 15/14* (2006.01)
*B24B 23/02* (2006.01)
*B24D 15/02* (2006.01)

(52) U.S. Cl.
CPC ..... *A63D 15/14* (2013.01); *B24B 23/02* (2013.01); *B24D 15/02* (2013.01)

(58) Field of Classification Search
CPC ..... A63D 15/14; B24B 23/02; B24D 15/02
USPC ..... 451/344, 523, 524, 548, 549
See application file for complete search history.

(56) References Cited

U.S. PATENT DOCUMENTS

D286,852 S * 11/1986 Ditmanson ..... D8/61
4,785,586 A * 11/1988 Kratfel ..... B24D 15/02 30/494
4,827,618 A * 5/1989 Lynn ..... A63D 15/14 30/374
5,104,122 A * 4/1992 Gossman ..... A63D 15/16 473/1
5,129,187 A * 7/1992 Cain ..... A63D 15/14 30/494
5,865,682 A * 2/1999 Sutton ..... A63D 15/16 473/37
6,178,970 B1 * 1/2001 Purifoy ..... A61B 17/54 132/73.5
7,568,978 B1 * 8/2009 Probst ..... A63D 15/14 30/494
2003/0027651 A1 * 2/2003 Slacum ..... A63D 15/14 473/36
2008/0113595 A1 * 5/2008 Xie ..... A63D 15/14 451/552
2009/0203456 A1 * 8/2009 Tao ..... A63D 15/14 473/51
2010/0075769 A1 * 3/2010 Contestabile ..... A63D 15/12 473/49

(Continued)

FOREIGN PATENT DOCUMENTS

GB 2370238 A * 6/2002 ..... A63D 15/14
KR 20180003011 U 10/2018

OTHER PUBLICATIONS

Porper's tip burnisher amazon web page https://www.amazon.com/Sterling-Gaming-JPTTTB-Porpers-Burnisher/dp/B0753GMJ1N/ref=sr_1_5?ie=UTF8&qid=1544659587&sr=8-5&keywords=pool+cue+tip+burnisher.

*Primary Examiner* — Eileen P Morgan
(74) *Attorney, Agent, or Firm* — Michael J. Tavella

(57) ABSTRACT

A hand-held battery powered tool used for tip shaping and reshaping a tip on a cue stick used for playing pool, billiards, snooker, etc. The tip is shaped by a mounting a rotating concave abrasive adapter that is powered in a hand-held housing that allows a user to center the tip directly into the center of the concave abrasive attachment for precise shaping accuracy in seconds. The abrasiveness of the attachment is equal to 80 grit sand paper, although grits from 60 to 120 grit may also be used. The size of the opening at the front end of the housing also allows a user to angle the cue to shape the side walls of the tip to further correct the curvature of the tip. Finally, a burnisher is also provided at the back of the housing to put a final finish on the tip.

10 Claims, 7 Drawing Sheets

(56) References Cited

U.S. PATENT DOCUMENTS

| | | | | |
|---|---|---|---|---|
| 2010/0240466 | A1* | 9/2010 | Elder | A63D 15/16<br>473/35 |
| 2010/0311314 | A1* | 12/2010 | Cordova | A63D 15/14<br>451/552 |

* cited by examiner

HAND-HELD POWERED POOL CUE TIP SHAPER

CROSS REFERENCE TO RELATED APPLICATIONS

This application claims benefit of Provisional application 62/398,684 filed Sep. 23, 2016.

STATEMENT REGARDING FEDERALLY SPONSORED RESEARCH AND DEVELOPMENT

Not Applicable

BACKGROUND OF THE INVENTION

1. Field of the Invention

This invention relates to pool cue tip shapers and particularly to hand-held pool cue tip shapers

2. Description of the Prior Art

Pool cues have tips on them that are typically covered with chalk to provide control when striking the cue ball. Over time, the tip gets smoothed and loses its ability to properly hold the chalk. Pool cue tip shapers are often employed to refurbish the cue tips. These tend to be either small mechanical devices that are operated manually or are large, mounted machines, like lathes. What is needed is a small, hand-held powered device that can quickly shapes a pool cue tip in a location, such as a pool room, which are not readily suitable for large power tools.

BRIEF DESCRIPTION OF THE INVENTION

The instant invention overcomes this problem. It is a hand-held battery powered tool used for tip shaping and reshaping a shape-able cue tip on a cue stick used for playing pool, billiards, or snooker. The tip is shaped by mounting a rotating concave abrasive adapter that is powered by a motor in a hand-held housing that allows a user to center the tip directly into the center of the concave abrasive attachment for precise shaping accuracy in seconds. The abrasiveness of the attachment is equal to 80 grit sand paper, although grits from 60 to 120 grit may also be used. The size of the opening at the front end of the housing also allows a user to angle the cue to shape the side walls of the tip to further correct the curvature of the tip. Finally, a burnisher is also provided at the back of the housing to put a final finish on the tip.

DETAILED DESCRIPTION OF THE INVENTION

Figure 1:
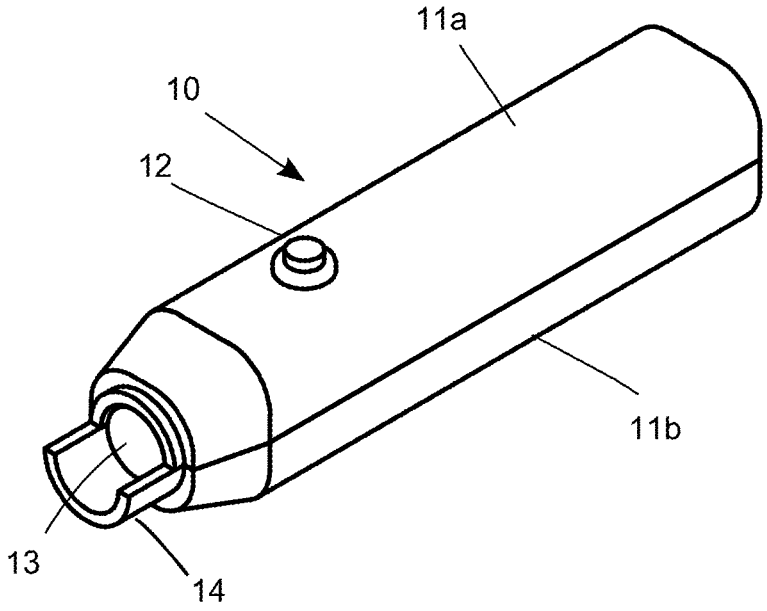
FIG. 1 is a top perspective view of the hand-held powered pool cue tip shaper.

Referring now to the drawings, FIG. 1 shows a top perspective view of the hand-held powered pool cue tip shaper. The invention consists of an upper housing 11*a* and a lower housing 11*b* (see FIG. 3). The upper housing 11*a* has a button 12 installed to control the motor (discussed below). The front of the upper housing 11*a* has one-half of the front opening 13 (see also FIGS. 3 and 7). The lower housing has the other one-half of the front opening 13. This portion of the housing also has a lip 14 that is semi-cylindrical in shape. This lip helps to support a pool cue when it is inserted into the opening 13.

Figure 2:
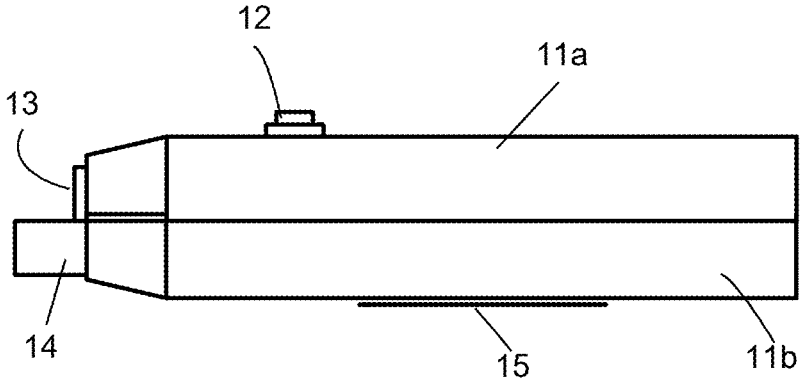
FIG. 2 is a right side view of the invention.

FIG. 2 is a right side view of the invention. In this view, the upper housing 11*a* and lower hosing 11*b* are shown with the button 12, the front opening 13 and the lip 14. Note also that this view shows a side view of the battery box cover plate 15, which is discussed in greater detail below.

Figure 3:
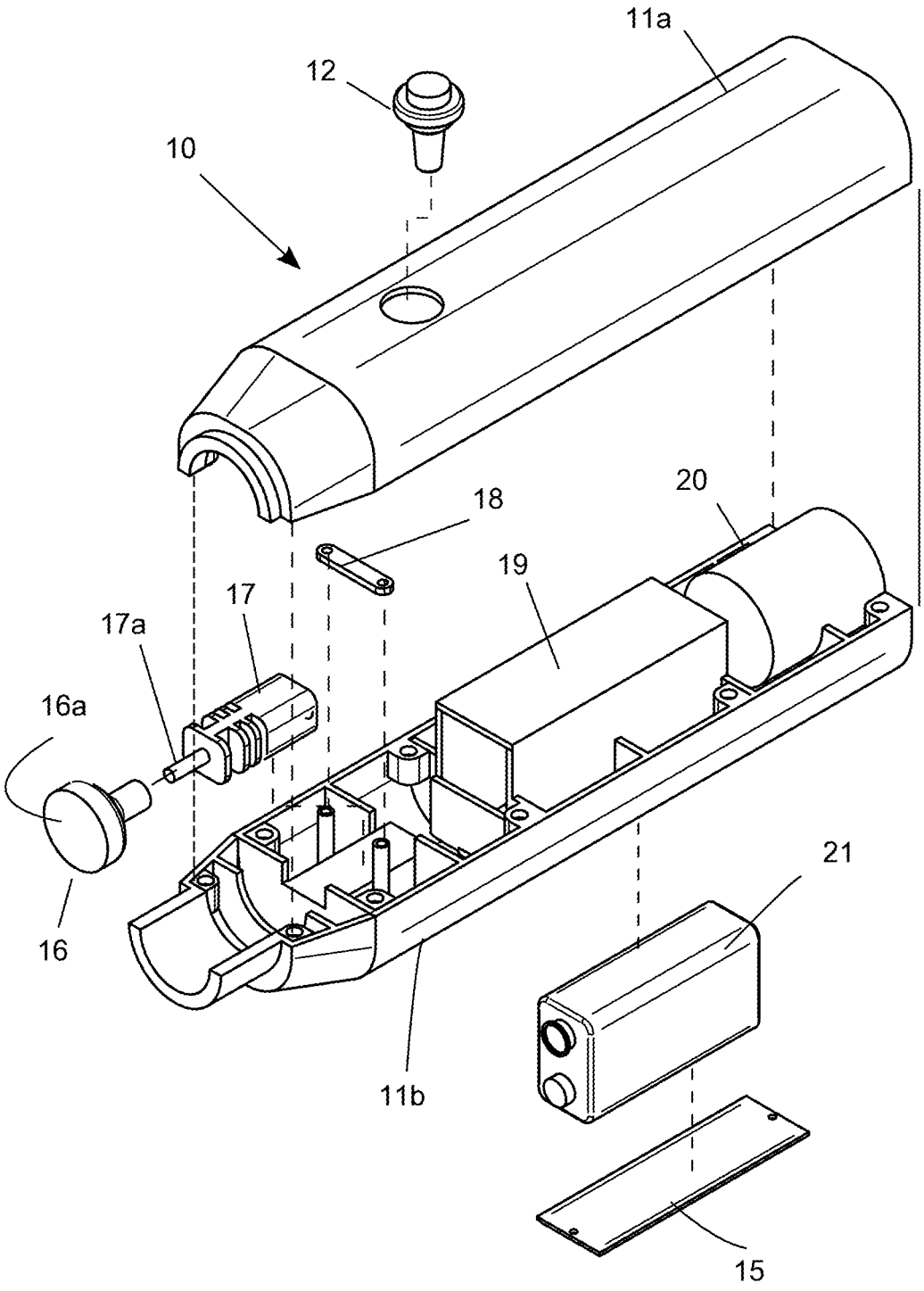
FIG. 3 is an exploded view of the invention.
Figure 4:
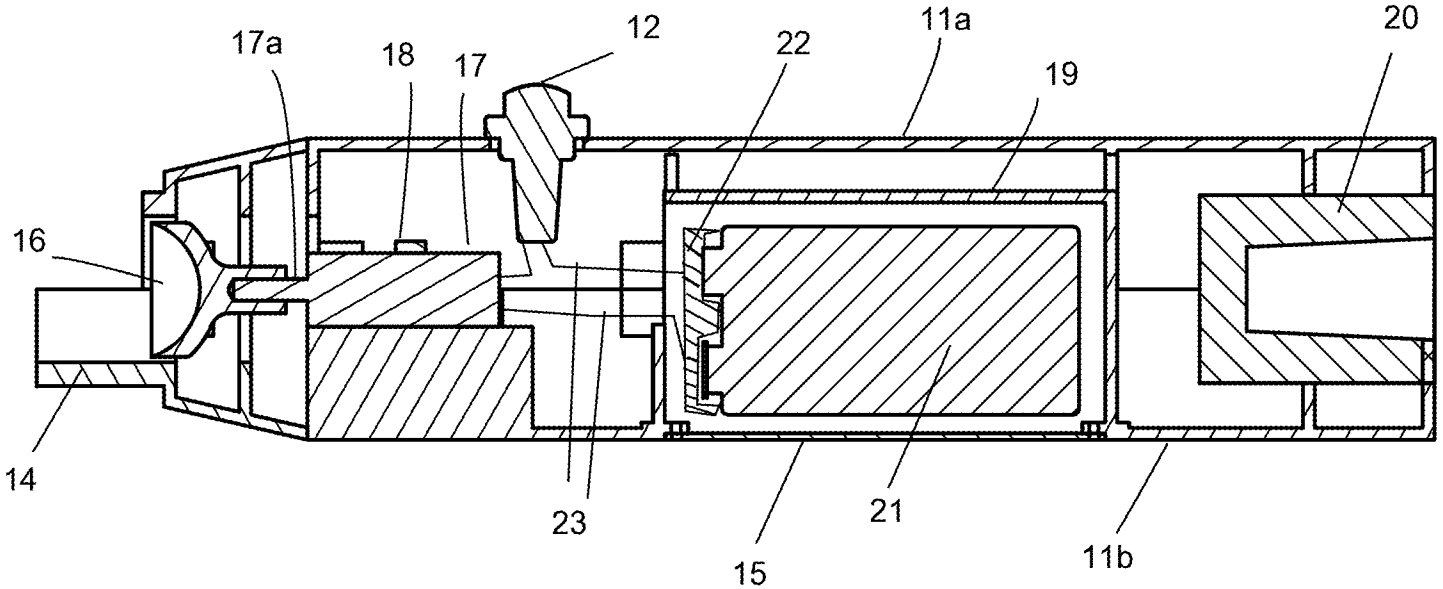
FIG. 4 is a cross-sectional view of the invention taken alone the lines 4-4 of FIG. 7.

FIG. 3 is an exploded view of the invention. In this view, the interior components of the device are shown as well as the exterior components discussed above. As shown the invention 10 has the upper housing 11*a*, lower hosing 11*b*, the button 12, the front opening 13 and the lip 14 as discussed above. Inside the housing is a shaper tip 16, a motor 17 with a shaft 17*a*. A motor retaining bracket 18, a battery box 19 (the battery connector and wiring are shown in FIG. 4), and a burnisher 20. A battery 21 and the battery box cover 15 are also shown.

In the preferred embodiment, the motor is a micro gear motor from Digi-Key electronics, 701 Brooks Avenue South, Thief River Falls, Minn. 567. The part number is 1568-1159-ND. Of course similar motors may be used as well.

Figure 6:
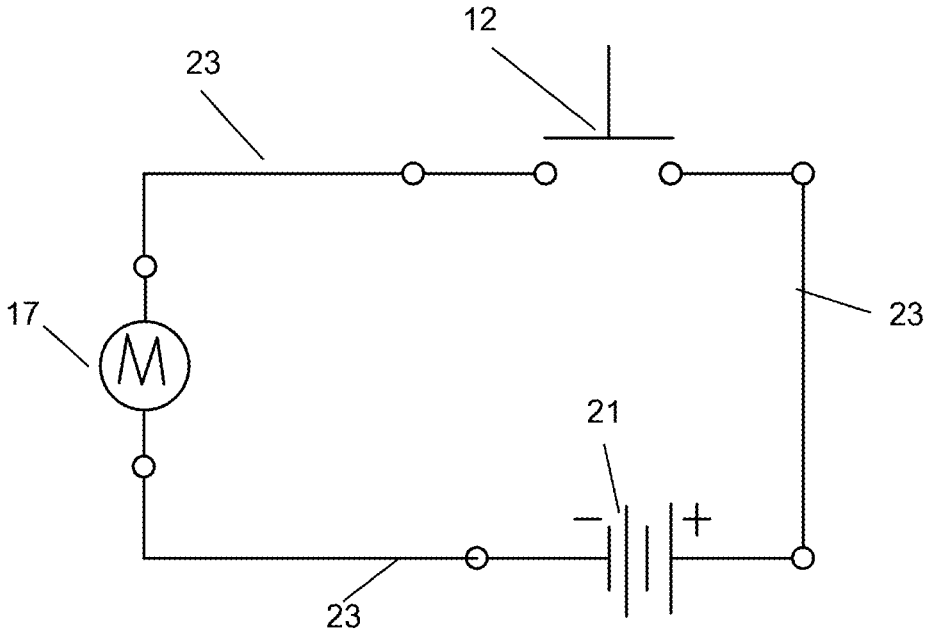
FIG. 6 is a wiring diagram of the electrical components.
Figure 7:
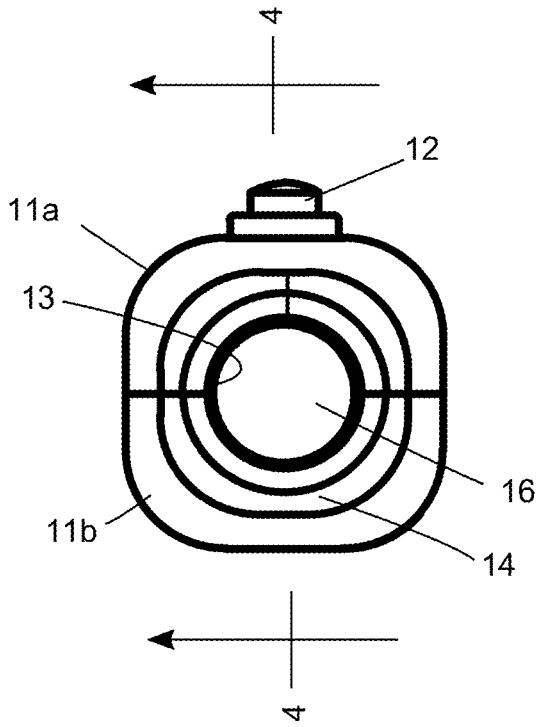
FIG. 7 is a front view of the invention.

FIG. 4 is a cross-sectional view of the invention taken alone the lines 4-4 of FIG. 7. In this view, the the upper housing 11*a*, lower hosing 11*b*, the button 12, the front opening 13 and the lip 14 are all shown as well as the shaper tip 16, the motor 17 with shaft 17*a*, the motor retaining bracket 18, the battery box 19, a burnisher 20, the battery 21 and the battery box cover 15. This view also shows the battery connector 22 and the wires 23. Note, FIG. 6 is a schematic wiring showing the electrical connections. The switch 12 is preferably an on-off type that does not have to be held in an on position. Of course, any type of push-button type switch, suitable for the voltage and current (9*v* DC) can be used.

Note too that the shaper tip 16 is attached to the shaft 17*a* of the motor, as discussed below.

The burnisher 20 is a plastic cylinder (see also FIGS. 3 and 8), which is designed to accept the tip of a pool cue. Turning the cue tip against the plastic sides of the burnisher 20 flattens out any mushrooming of the tip. The inner surface of the burnisher cylinder is tapered to allow any size cue to fit. Note that the burnisher need not be used with the shaper. Anytime a cue tip needs burnishing, the tip can be inserted into the burnisher 20 as discussed above.

Figure 5:
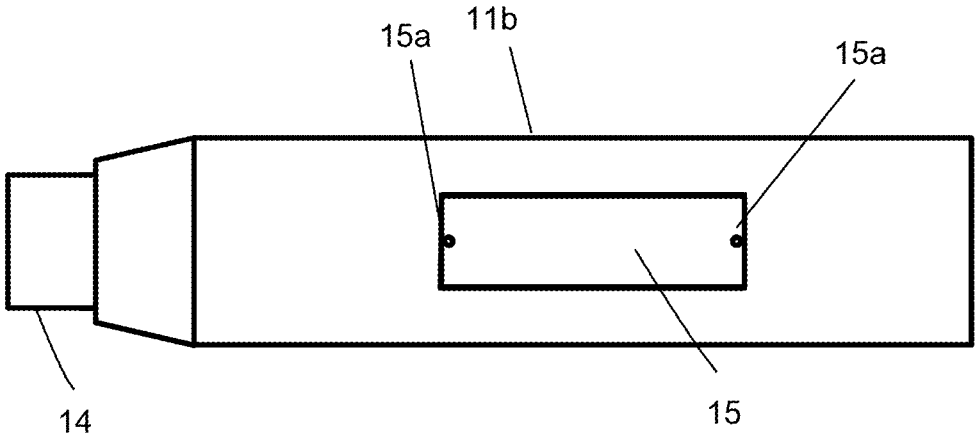
FIG. 5 is a bottom view of the invention.

FIG. 5 is a bottom view of the invention. This view shows the batter box cover 15 installed in the lower housing 11*a*. Note that two screws 15*a* are shown securing the cover in place. However, any common technique for holding such covers in place may be used.

FIG. 6 is a wiring diagram of the electrical components. As shown, the battery 21 has a positive terminal and a negative terminal. The negative terminal is connected by wire 23 to one terminal of the motor 17. The positive terminal is attached by another wire 23 to one side of the switch 12 and the other side of the switch is connected, by wire 23 to the other terminal of the motor 17 as shown.

FIG. 7 is a front view of the invention. Here, the upper housing 11*a*, lower hosing 11*b*, the button 12, the front opening 13 the lip 14 and the shaper tip 16 are shown.

Figure 8:
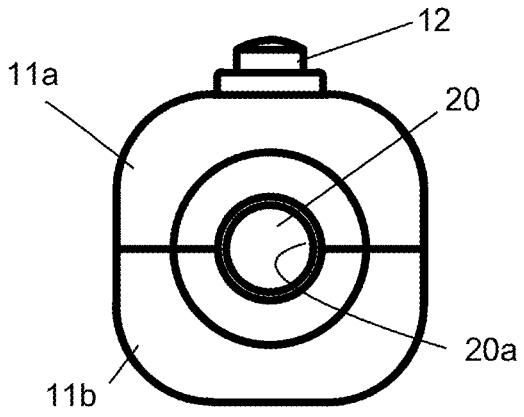
FIG. 8 is a rear view of the invention.

FIG. 8 is a rear view of the invention. Once again, the upper housing 11*a*, lower hosing 11*b*, the button 12 are shown as well as the burnisher 20 and the opening 20*a* to access the burnisher.

Figure 9:
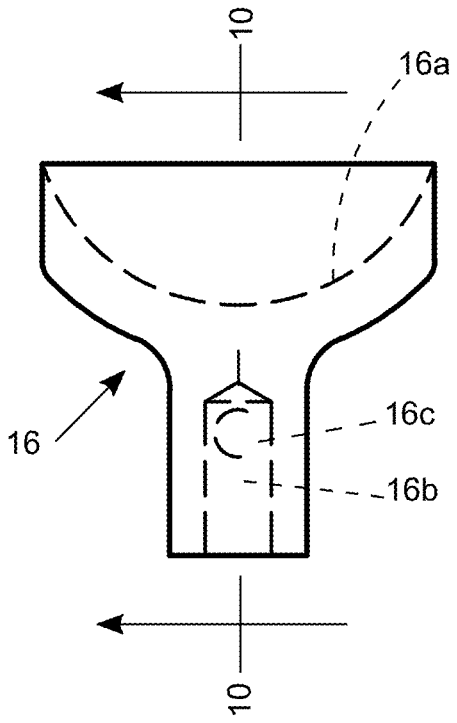
FIG. 9 is a side view of the shaper tip.

FIG. 9 is a side view of the shaper tip. The shaper tip 16 is a formed member, preferably metal. It has an inner concave surface 16*a* as described below. At the base of the shaper tip 16 is a opening 16*b* to accept the motor shaft 17*a*. This opening has a setscrew 16*c* that holds the shaper tip 16 secularly to the motor shaft 17*a*. The radius of the concave surface is described below.

Figure 10:
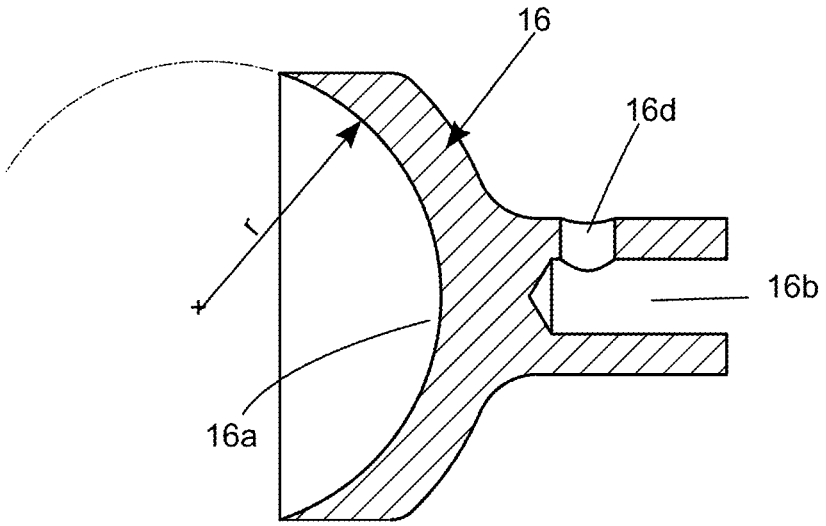
FIG. 10 is an enlarged cross-section of the shaper tip. Taken along the lines 10-10 of FIG. 9.

FIG. 10 is an enlarged cross-section of the shaper tip. Taken along the lines 10-10 of FIG. 9. In this figure, the inner concave surface 16*a* and the opening 16*b* are shown. Note that the threaded recess 16*d* for the setscrew 16*c* is shown. The radius of the concave surface is determine by common pool cue tip shapers. These shapers can create a tip with the radius of a U. S. dime, commonly called a "dime tip" or, shaped to the radius of a U. S. nickel, commonly called a "nickel tip". Currently, most pool players prefer the "dime tip". Thus, two shaper tips are provided. One for the "dime tip" and the other for the "nickel tip". The radius of the dime tip is preferably 0.38 inches and for the nickel tip is 0.42 inches.

Figure 11:
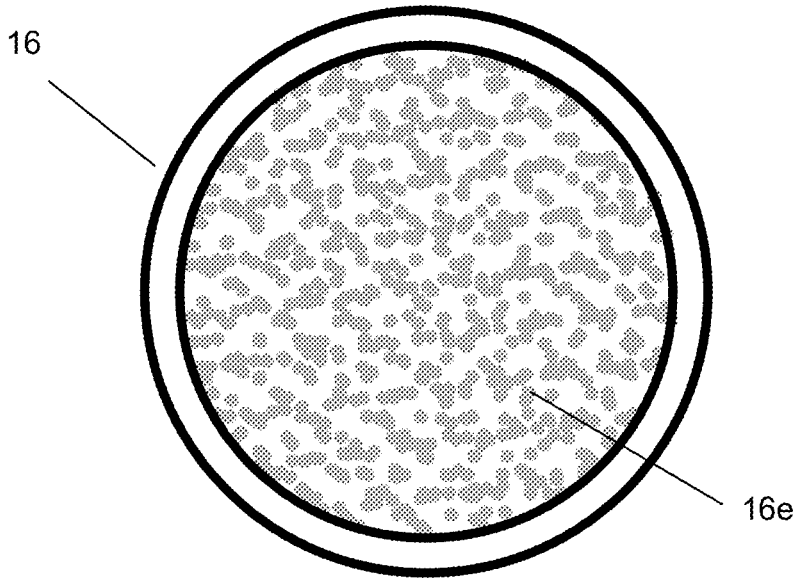
FIG. 11 is a front view of the shaper tip showing the abrasive surface.

Note too, that the shaper tip has an abrasive surface 16*e*, which is the subject of a application 62/480,737 the subject matter of which is incorporate herein by reference. FIG. 11 is a front view of the shaper showing the abrasive surface 16*e*. In the preferred embodiment, this abrasive surface 16*e* has a texture equal to that of 80 grit sandpaper. However, the range of equivalent texture is between about 60 and 120 grit sandpaper.

In the preferred embodiment, the overall size of the device is as follows: length 7.44 inches (including the lip 14); height of 1.6 inches (without the switch 12); and a width of 1.6 inches. The preferred battery size is a standard 9 volt type.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A pool cue tip shaper comprising:

a) an outer housing formed from an upper housing and a lower housing, the outer housing having a front and a back, the front of said outer housing also having an opening formed in the upper and lower housings, the lower housing having a lip extending outwardly from said opening in said lower housing to support a pool cue when inserted into opening;

b) a motor, installed inside said housing;

c) a power source, installed within said housing and being in electrical communication with said motor;

d) a shaper tip, having an abrasive, concave surface, said shaper tip being installed within said outer housing and being in mechanical communication with said motor, said shaper tip being aligned with the opening in the front of said housing such that a pool cue inserted into said opening contacts said shaper tip; and e) a burnisher installed in said outer housing, wherein the back of said outer housing has a hole formed therein to access said burnisher.

2. The pool cue tip shaper of claim 1 further comprising an operating switch, installed on the top of said housing, and further wherein said switch is in electrical communication with said power source and said motor.

3. The pool cue tip shaper of claim 1 wherein said motor further comprises a shaft, extending outwardly from said motor.

4. The pool cue tip shaper of claim 3 wherein the shaper tip is attached to the shaft of said motor.

5. The pool cue tip shaper of claim 1 wherein the power source is a battery removably installed within said outer housing.

6. The pool cue tip shaper of claim 5 further comprising an access door, attached to the bottom of said outer housing to access said battery.

7. The pool cue tip shaper of claim 1 wherein the shaper tip has an abrasive surface of between about 60 and 120 grit.

8. The pool cue tip shaper of claim 1 wherein the shaper tip has an abrasive surface of 80 grit.

9. The pool cue tip shaper of claim 1 wherein the concave surface has a radius of 0.38 inches.

10. The pool cue tip shaper of claim 1 wherein the concave surface has a radius of 0.42 inches.

* * * * *